US009097202B2

(12) United States Patent
He et al.

(10) Patent No.: US 9,097,202 B2
(45) Date of Patent: Aug. 4, 2015

(54) WEIGHT BALANCED INTERNAL COMBUSTION ENGINE PISTON

(75) Inventors: Jie He, Aurora, IL (US); Jeffrey Paul Buening, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 530 days.

(21) Appl. No.: 12/916,727

(22) Filed: Nov. 1, 2010

(65) Prior Publication Data

US 2011/0100317 A1 May 5, 2011

Related U.S. Application Data

(60) Provisional application No. 61/256,894, filed on Oct. 30, 2009.

(51) Int. Cl.
*F02F 3/22* (2006.01)
*F02F 3/00* (2006.01)

(52) U.S. Cl.
CPC . *F02F 3/003* (2013.01); *F02F 3/22* (2013.01); *F02F 2200/04* (2013.01); *Y10T 29/49249* (2015.01)

(58) Field of Classification Search
CPC ..... F02F 3/22–3/225; F02F 3/00; F02F 5/00
USPC ..... 123/193.1, 193.6
See application file for complete search history.

(56) References Cited

U.S. PATENT DOCUMENTS 2,244,166 A * 6/1941 Marien ..... 92/160
2,511,458 A * 6/1950 Bramberry, Sr. ..... 92/160
3,190,273 A * 6/1965 Bachle et al. ..... 123/41.35
3,943,908 A * 3/1976 Kubis et al. ..... 123/193.6
5,179,916 A 1/1993 Schönfeld
5,901,678 A 5/1999 Bielaga
6,223,710 B1 5/2001 Franz
6,491,013 B1 12/2002 Gaiser et al.
6,502,539 B2 * 1/2003 Ribeiro et al. ..... 123/193.4
6,539,910 B1 4/2003 Gaiser et al.
6,557,514 B1 5/2003 Gaiser
6,862,976 B2 * 3/2005 Gaiser et al. ..... 92/186
6,957,638 B2 10/2005 Scharp
7,387,100 B2 6/2008 Fiedler et al.

(Continued)

FOREIGN PATENT DOCUMENTS

JP 03-008640 1/1991
KR 20-1996-0034883 11/1996

(Continued)

*Primary Examiner* — Lindsay Low
*Assistant Examiner* — Kevin Lathers
(74) *Attorney, Agent, or Firm* — Leydig, Voit & Mayer, Ltd.

(57) ABSTRACT

A piston for an internal combustion engine includes a piston crown connected to and above a body portion of the piston. The body portion forms two pin bores and the piston crown defines an outer cylindrical wall. At least one piston ring seal groove is formed in the outer cylindrical wall and extends peripherally around the piston crown. A first oil collection groove is formed in the outer cylindrical wall below the piston ring seal groove. The first oil collection groove has a first width measured along a centerline of the piston. A second oil collection groove is formed in the outer cylindrical wall below the first oil collection groove, extends parallel to the first oil collection groove around the entire periphery of the piston, and has a width that is at least double the width of the first oil collection groove.

13 Claims, 5 Drawing Sheets

(56) References Cited

U.S. PATENT DOCUMENTS

| | | | |
|---|---|---|---|
| 2003/0101958 | A1 | 6/2003 | Han |
| 2006/0096557 | A1 | 5/2006 | Christain et al. |
| 2007/0074695 | A1 | 4/2007 | Gildemeister et al. |
| 2009/0145394 | A1 | 6/2009 | Nigro et al. |
| 2009/0151688 | A1* | 6/2009 | Matsui et al. ..... 123/193.6 |

FOREIGN PATENT DOCUMENTS

| | | |
|---|---|---|
| KR | 10-0450441 | 9/2004 |
| WO | 03-036045 | 5/2003 |

* cited by examiner

- PRIOR ART-

- PRIOR ART-

WEIGHT BALANCED INTERNAL COMBUSTION ENGINE PISTON

CROSS-REFERENCE TO RELATED APPLICATIONS

This patent application claims the benefit of U.S. Provisional Patent Application No. 61/256,894 filed Oct. 30, 2009, which is incorporated herein in its entirety by reference.

TECHNICAL FIELD

This patent disclosure relates generally to internal combustion engines and, more particularly, to pistons operating within engine bores.

BACKGROUND

Internal combustion engines include one or more pistons interconnected by connecting rods to a crankshaft, and are typically disposed to reciprocate within bores formed in a crankcase, as is known. A typical piston includes a head portion, which at least partially defines a combustion chamber within each bore, and a skirt, which typically includes a pin opening and other support structures for connection to the connecting rod of the engine. In general, a piston is formed to have a generally cupped shape, with the piston head forming the base, and the skirt portion being connected to the base and surrounding an enclosed gallery of the piston. In typical applications, lubrication oil from the engine is provided within the gallery of the piston during operation to convectively cool and lubricate various portions of the piston.

A typical piston head also includes an outer cylindrical wall having one or more circumferentially continuous grooves formed therein. These grooves typically extend parallel to one another and are appropriately sized to accommodate sealing rings therewithin. These sealing rings create sliding seals between each piston and the crankcase bore it is operating within. Typically, the groove located closest to the skirt of the piston accommodates a scrapper ring, which is arranged to scrape oil clinging on the walls of the piston bore during a down-stroke of the piston. Oil that may remain wetting the walls of the bore following the down-stroke of the piston may enter the combustion chamber and combust during operation of the engine.

One known solution for improving the removal of oil found on the bore walls during a down-stroke of the piston can be seen in U.S. Pat. No. 6,557,514, which is incorporated herein in its entirety by reference (hereafter, "the '514 patent"). The '514 patent discloses a piston having an outer wall defined in part by a ring belt and including an oil gallery defined internally to the piston. An oil drainage groove is machined into the outer surface of the ring belt of the cylindrical side wall of the piston head, below two piston ring seal grooves. The oil drainage groove is partially defined by a bottom wall that extends circumferentially about the piston but is interrupted such that oil gathered in the oil groove can drain downwardly back into the crankcase of the engine. An upper wall of the oil drainage groove extends about the circumference of the body of the piston. As disclosed in the '514 patent, the upper ring grooves accommodate piston rings, while the bottom-most groove is free of piston rings and is arranged to collect oil as the piston undergoes a down-stroke.

The oil collection groove disclosed in the '514 patent is at least partially effective in reducing the amount of oil left behind on the cylinder wall after the piston has undergone a down-stroke.

With the foregoing as background, it is sometimes the case that a mature engine design, especially one that is already sold to consumers, is in need of improvements in performance, cost, or sourcing of components, which will render the engine more successful in the marketplace. Such product improvements for engines are especially valuable to an engine manufacturer if reverse compatibility of new components to be used in place of original engine components is preserved. Nevertheless, it has traditionally been the case that engine pistons are not considered as components that may be redesigned mid-stream through the product life cycle of a particular engine.

The unsuitability of engine pistons as components that may be redesigned to fit an existing engine and replace an existing, baseline piston design is because, in large part, design changes made to a piston will often require a cascading series of changes to other engine components. For example, a design update to a piston may cause changes to the weight balancing, performance, and/or any other functional attribute of the piston, which in turn will necessitate changes to the counterweights of the crankshaft, or changes to connecting rods and to engine calibration. Moreover, it is conceivable that engine overhaul service providers may replace some pistons but leave others with less wear or damage alone which would cause serious performance problems if the replacement piston was a different weight as compared to the original piston. Any such changes to the design of engine components renders retrofitting of certain components, such as pistons, effectively unsuitable for current-production engines.

DETAILED DESCRIPTION

This disclosure relates to pistons for use in internal combustion engines and, particularly, direct injection compression ignition engines. Particularly, the disclosure provides a method of achieving a design of pistons that are reverse compatible with engines having baseline pistons already in service. As used herein, reverse compatibility refers to the ability of interchangeably using original or baseline pistons and retrofit pistons using tooled piston blanks without requiring changes in other engine components. Thus, such retrofit or redesigned pistons may be used during new engine construction, or even to replace baseline pistons during service. Additionally, retrofit pistons may be arranged as after-market parts to improve the performance of existing engines.

Figure 1:
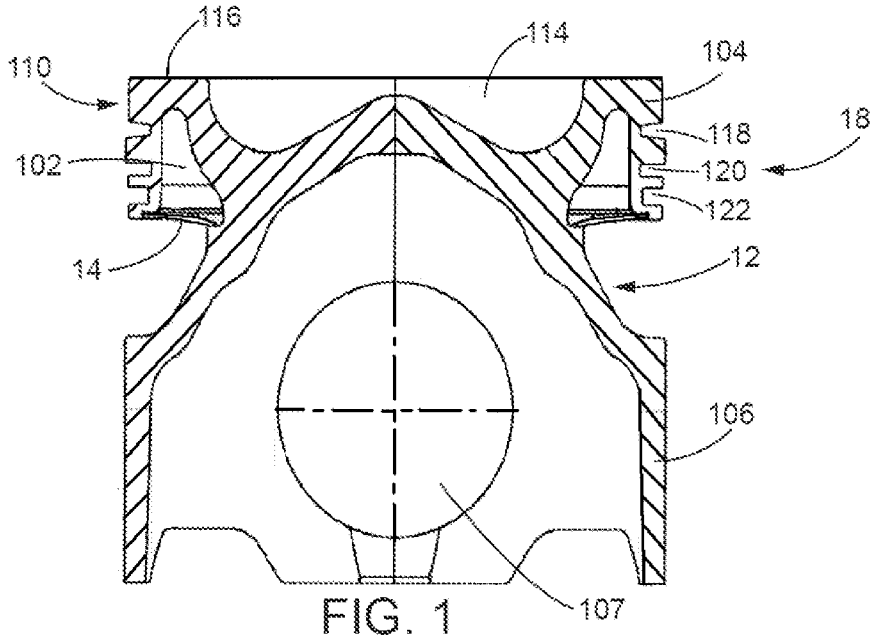
FIG. 1 is a section view of a known Monotherm®-type piston, manufactured by Mahle, hereinafter referred to as a baseline piston.
Figure 2:
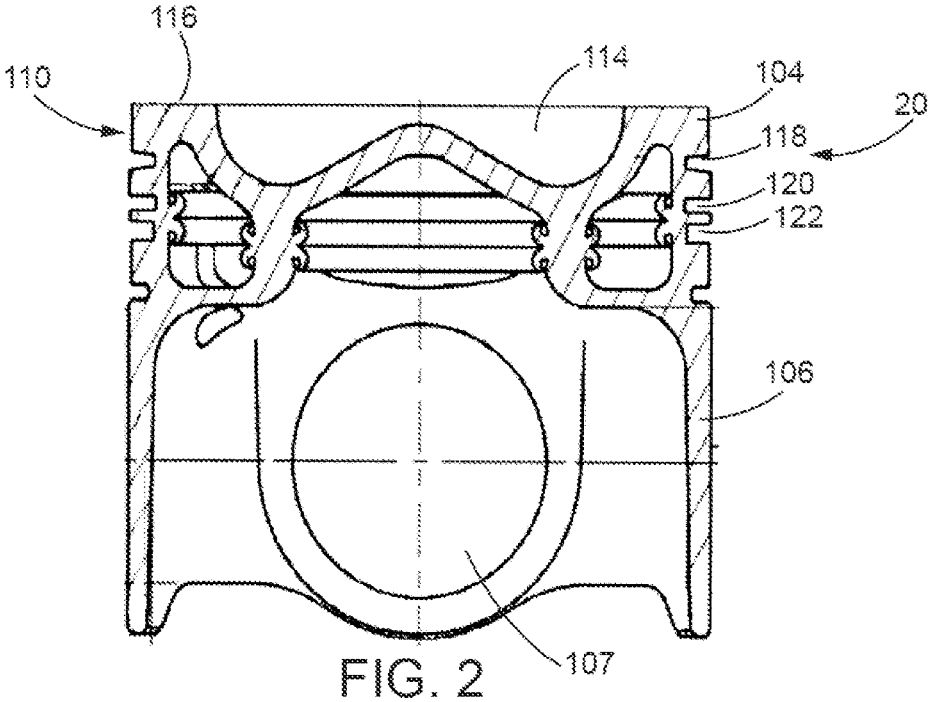
FIG. 2 is a section view of a known Monosteel®-type piston, manufactured by Federal Mogul, hereinafter referred to as a piston blank.
Figure 3:
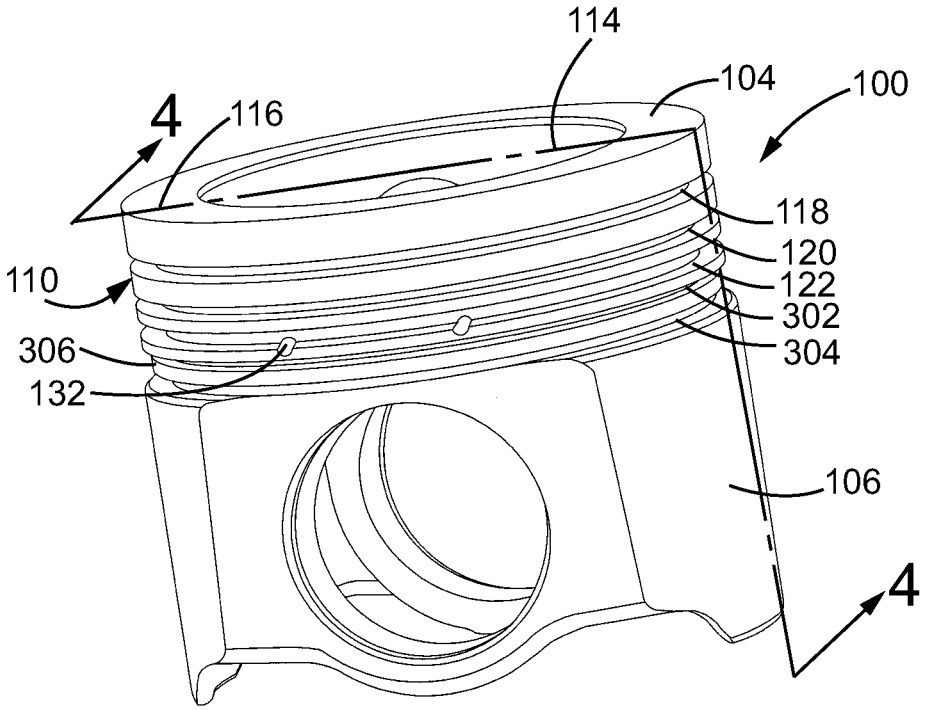
FIG. 3 is an outline view of a first embodiment of a piston in accordance with the disclosure.
Figure 4:
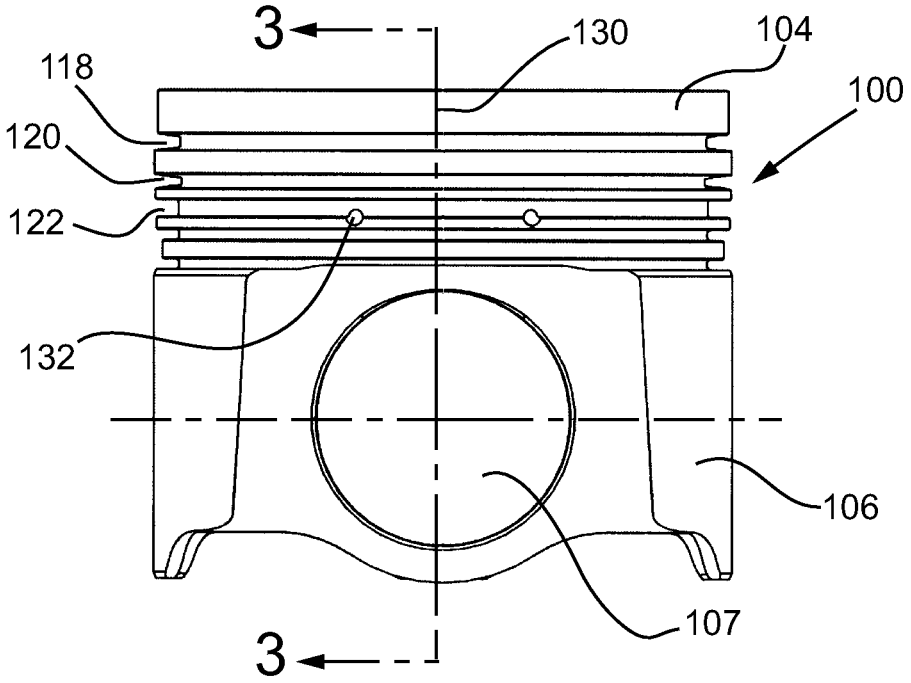
FIGS. 4-7 are various views of the piston shown in FIG. 1.

Two examples or prior art pistons 10 and 20 are presented, respectively, in FIGS. 1 and 2. The piston 18 illustrated in FIG. 1 is of a Monotherm®-type, and may hereafter be referred to as the baseline piston. The piston 20 illustrated in FIG. 2 is of a Monosteel®-type, and may hereafter be referred to as a piston blank. For simplicity, features of the baseline piston 18 and of the piston blank 20 that are the same or similar as features of the improved pistons 100 and 200 disclosed subsequently herein are denoted by the same reference numerals throughout the various views of the figures.

The baseline piston 18 shown in FIG. 1 includes various features unique to its design. Particularly, the baseline piston 18 is made by a forging process out of a unitary mass of metal. The baseline piston 18 includes a neck-down portion 12 separating a head portion or crown

104 thereof from a body portion 106. An enclosed oil cooling gallery 102 is formed within the head portion 104 and is enclosed by an annular ledge 14. For purpose of the present disclosure, the baseline piston 18 will be considered as a baseline component that is suitable for a particular engine application and which has already been installed on engines sold to customers and operating in the field. For various reasons, such as component cost, availability of after-market or service parts, or desired engine performance improvements, an engine manufacturer may desire to replace the baseline piston 18 with an improved piston but without the need to further replace other engine components that are associated with the piston, such as the crankshaft.

Regarding component replacement at service or overhaul certain components such as pistons may be scheduled to be replaced at certain service intervals or at least inspected and replaced if wear is excessive. Pistons and piston rings are commonly replaced at overhaul however others such as the crankshaft and camshaft are not commonly replaced if possible. When a piston is to be replaced during such service event certain aspects of the baseline piston should be preserved and certain aspects of the replacement piston should not be substantially different from the baseline piston to ensure proper performance and emission control. The replacement piston should be "weight-balanced" or generally the same weight as the baseline piston. The replacement piston should have a substantially similar combustion bowl as the baseline piston and the ring groove geometry and placement should be similar to ensure proper performance and emissions control.

A piston blank 20 is shown in FIG. 2. The piston blank 20 may be a piston that is already available by a piston manufacturer that has many of the desired features already incorporated in its design, but that is deficient in certain aspects, such as its weight. Features of the piston blank 20 that are the same or similar to features of the baseline piston 18 or features of the improved pistons 100 and 200 as those are illustrated in FIGS. 3-12 are denoted by the same reference numerals for simplicity. In one embodiment, the piston blank 20 may be heavier than the baseline piston 18 by small amounts, for example, as little as 1 gram, or my larger amounts, for example, 105 grams or more.

Two embodiments of improved pistons suitable for retrofitting are disclosed herein. Each of the improved pistons illustrates a weight balancing operation performed on a piston blank to match the weight of a baseline piston. For instance, more weight has been removed from the piston 200 (as shown in FIGS. 8-12) than from the piston 100 (as shown in FIGS. 3-7). The weight reduction of the improved pistons 100 and 200 is concentrated in weight reduction regions, which include the secondary oil collection channels as discussed further below. Further, a method for optimizing the design of a piston for a particular engine application is also disclosed. Both disclosed embodiments represent the result of modification to a base piston design or a piston blank. In the description that follows, structural features of the baseline piston 18 (FIG. 1), the piston blank 20 (FIG. 2), the first embodiment of an improved piston 100 (FIGS. 3-7), and of the second embodiment for an improved piston 200 (FIGS. 8-12) that are the same or similar are denoted in the figures and described in the drawings using the same reference numerals for simplicity. Nevertheless, it can be appreciated that pistons having features or structures that are different than those shown and described herein may be used.

FIGS. 1 and 2 illustrate, respectively, the baseline piston 18 and the piston blank 20. FIGS. 3-7 illustrate a first embodiment of a piston 100. FIGS. 6-10 illustrate a second embodiment of a piston 200. The pistons 100 and 200, as shown, are Monosteel®-type pistons having an enclosed cooling gallery 102 defined between a head or crown portion 104 and a pin or body portion 106. The pistons 100 and 200, as illustrated, were made from the piston blank 20 such that each matches the weight of a corresponding baseline piston, such as the baseline piston 18 (FIG. 1) and each have substantially similar ring grooves and combustion bowl geometry as compared to their baseline counterparts.

In each piston, the body portion 106 forms two pin bores 107. The head and body portions 104 and 106 of the pistons 100 and 200 may be frictionally welded to one another along seams 108. Each piston 100 or 200 defines an outer cylindrical wall 110 that extends over the head and body portions 104 and 106 as is best shown in the detail section of FIG. 7 or FIG. 12. The head portion 104 defines a combustion bowl 114, which is a depression formed in the head portion 104 extending over a generally central portion thereof. The combustion bowl 114 is surrounded by a top face 116 that, in the illustrated embodiment, perpendicularly intersects the outer cylindrical wall 110. The combustion bowl 114 intersects the top face 116 along a rim 117. As is known, the shape of the combustion bowl 114 can be optimized to provide desired combustion characteristics during operation of an engine.

A plurality of ring grooves that extend parallel to one another across a periphery portion of the outer cylindrical wall 110 includes an upper piston ring groove 118 disposed closest to the top face 116, a lower piston ring groove 120 disposed, as shown, below the upper piston groove 118, and a first oil collection groove 122 disposed below the lower piston ring groove 120. The upper and lower piston ring grooves 118 and 120, as well as the first oil collection groove 122, segment the outer cylindrical wall 110 into a plurality of "lands" or, stated differently, bands of cylindrical wall surface separating and spacing apart the grooves 118, 120, and 122. More particularly, a first or upper land 124 is defined between the upper piston ring groove 118 and the transition to the top face 116, a second land 126 is defined between the upper and lower piston ring grooves 118 and 120, and a third land 128 is defined between the lower piston ring and the first oil collection grooves 120 and 122, although other configurations or number of piston ring and oil collection grooves may be used.

As can be seen from the figures, the first, second, and third lands 124, 126, and 128 are generally aligned with the outer cylindrical wall 110. In other words, points on the first, second, and third lands 124, 126, and 128 are all at about the same radial distance from a centerline 130 of the piston 100 or 200, without regard to any draft angles or other variations to the cylindrical shape of the outer cylindrical wall 110 that may be present in the piston.

When installed in an engine, each piston 100 or 200 is disposed within a cylinder bore (not shown) and includes a combustion ring seal (not shown) that is placed within the first or upper piston ring groove 118 in sealing contact between the piston 100 or 200 and the cylinder bore. The combustion ring seal operates to fluidly separate combustion byproducts and combustible mixtures present within the cylinder above the piston. An oil scrapper ring (not shown) may be disposed within the lower or second piston ring groove 120. The scrapper ring may operate to scrape oil clinging to the walls of the cylinder during a down-stroke of the piston, as previously discussed. Oil collected by the scrapper ring may be, at least temporarily, collected in the first oil collection groove 122 before draining back down the piston into the crankcase of the engine (not shown). In the illustrated embodiments, one or more drain openings 132 fluidly connect the first oil collection groove 122 with the enclosed cooling gallery 102, which permits oil collected in the groove 122 to drain through the piston into the crankcase of the engine.

The description thus far has discussed features of the pistons 100 and 200 that are commonly found on the baseline piston 18 (FIG. 1) and the piston blank 20 (FIG. 2) used in the illustrated embodiments, and which can define baseline performance characteristics of the engine, as discussed hereafter. Each piston 100 or 200, however, includes features that have been added to the piston blank 20 to optimize the weight of the piston blank and to improve the ability of the piston to efficiently remove oil collected during the down-stroke of the piston for specific engine applications. In one embodiment, a piston blank may be modified, such as by tooling the piston blank, to remove weight therefrom such that the weight of a baseline piston design is matched by the improved pistons disclosed herein. In such circumstances, material removed from the piston blank may achieve sufficient weight reduction that matches the weight of the baseline piston while at the same time also permitting the formation of the secondary oil collection grooves and other improvement features described herein. In general, it can be appreciated that a reduction in weight of a reciprocating piston within the engine improves the engine's moment of inertia, and thus increases the useable power output of the engine. Moreover, the ability of a piston to more readily remove oil collected from a cylinder wall during the down-stroke of the piston can lead to reduced engine oil consumption and emissions. The unique features of each of the two embodiments presented herein are now discussed in more detail.

Figure 5:
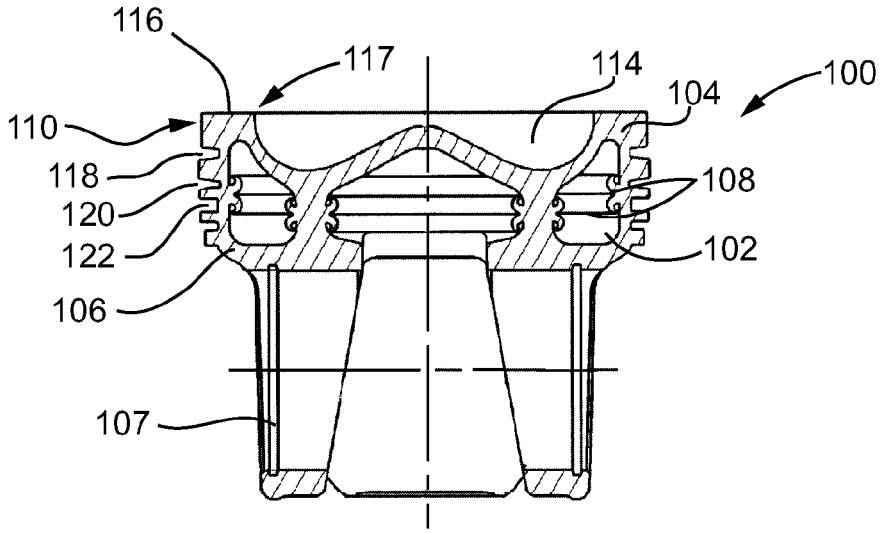
Figure 7:
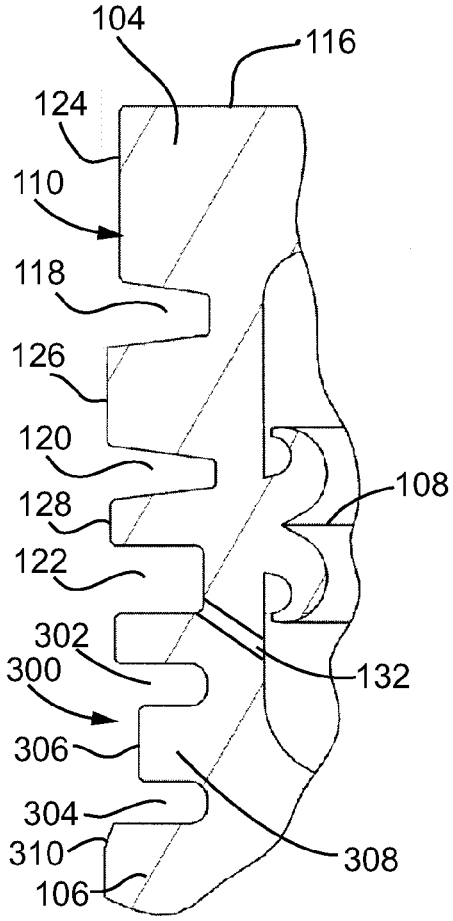
Figure 6:
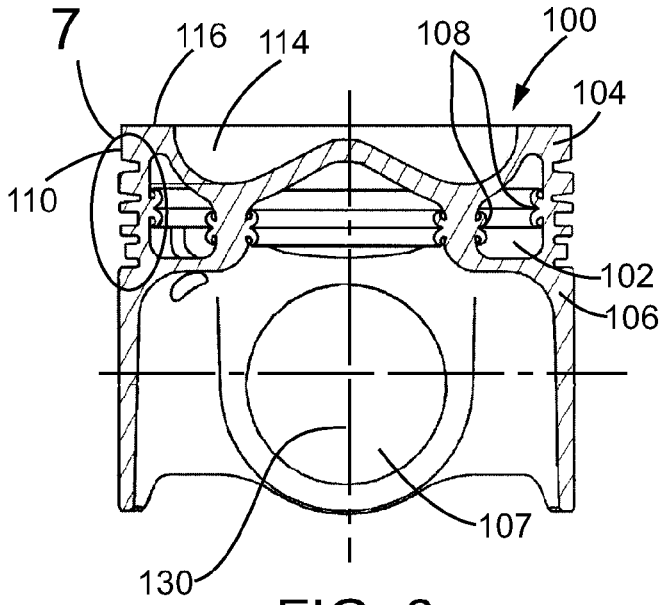
Figure 8:
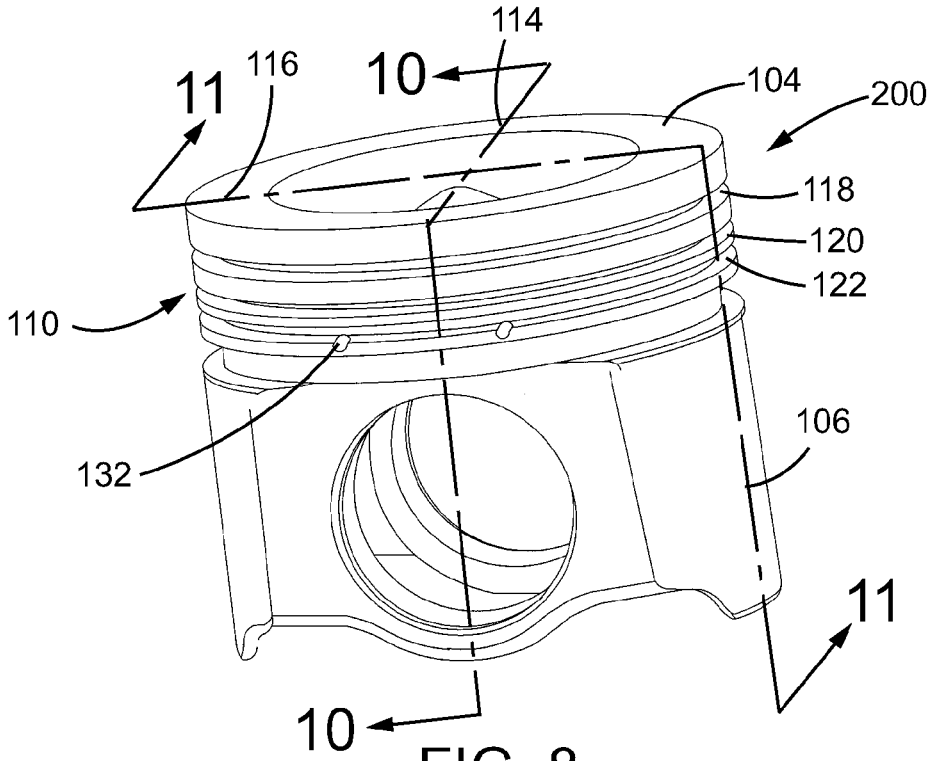
FIG. 8 is an outline view of a second embodiment of a piston in accordance with the disclosure.
Figure 9:
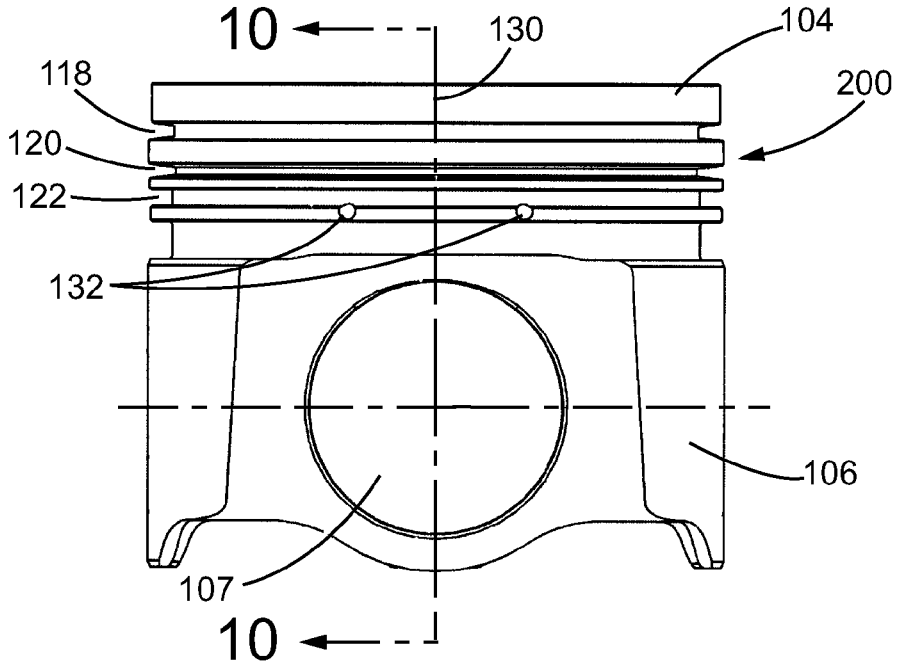
FIGS. 9-12 are various views of the piston shown in FIG. 6.

The piston 100 includes an additional or second oil collection groove 300, which is best shown in FIG. 7. Unlike the first oil collection groove 122, the second oil collection groove 300 is substantially wider and defines a first channel 302, a second channel 304, and a reduced-diameter land portion 306 disposed between the first and second channels 302 and 304. In the illustrated embodiment, the first channel 302 extends peripherally around the piston 100 just above an annular protrusion 308 that defines the reduced-diameter land portion 306. The second channel 304 is partially formed around the entire periphery of the piston 100, but is interrupted over reduced-diameter portions of the body portion 106 that accommodate the pin bores 107, as is best shown in FIG. 5. A chamfer 310 is formed along the interface between the bottom of the second channel 304 and the body portion 106 of the piston 100.

In the specific embodiment of the piston 100 illustrated in FIGS. 3-7, the second oil collection groove 300 has an overall width of about 9.5 mm. Each of the first and second channels 302 and 304 may be formed at a width, which is defined along the length of the piston 100, of about 2.5 mm and at a depth of about 5.34 mm. The reduced diameter land 306 (FIG. 7) is disposed between the first and second channels 302 and 304, has a width of about 4.5 mm, and is radially disposed about 1.34 mm from the surface of the outer cylindrical wall 110; in other words, the reduced diameter land 306 has a height in the radial direction relative to the piston 100 of about 4 mm. The chamfer 310 (FIG. 7) extends about 1.5 mm below the lower edge of the second channel 304 at an angle of about 20 degrees. Further, the upper edge or the edge closest to the combustion bowl 114 of the piston 100 is located about 33 mm below the top face 116.

Figure 10:
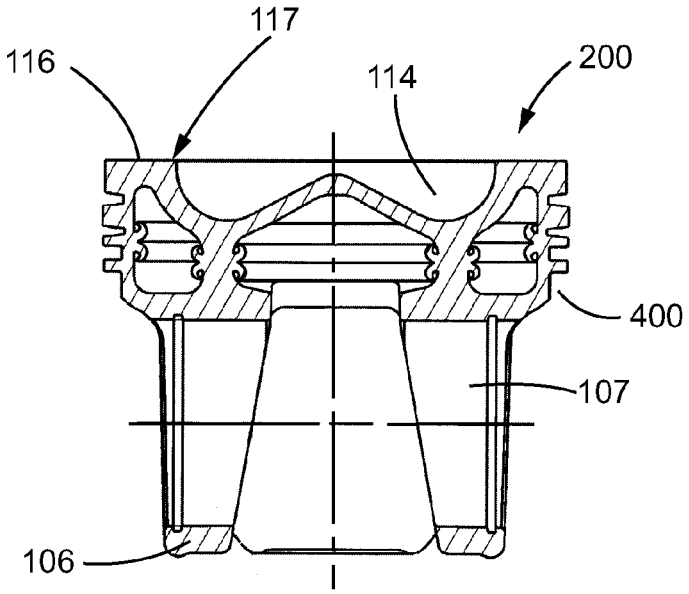
Figure 12:
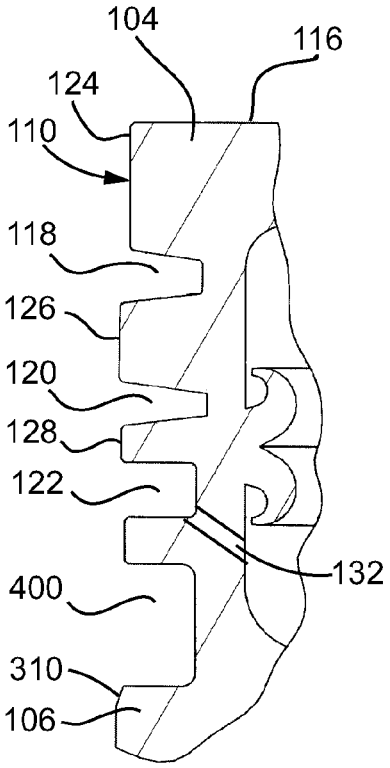
Figure 11:
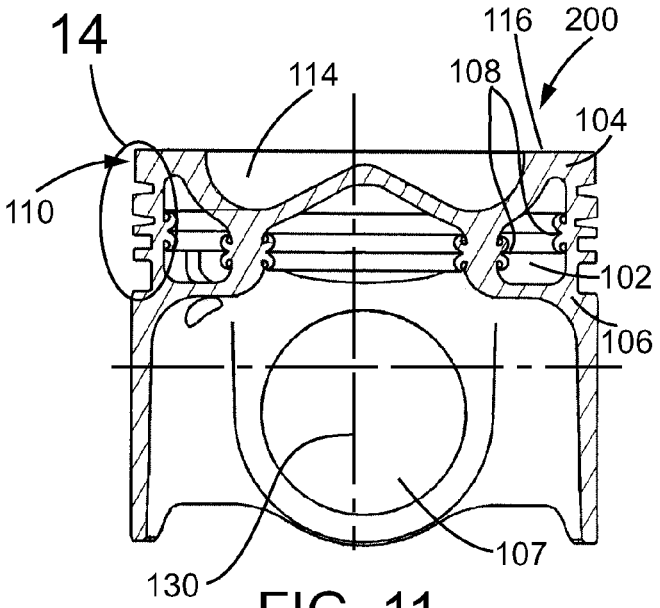

Similar to the piston 100, the piston 200 shown in FIGS. 8-12 includes an additional or second oil collection groove 400, which is best shown in FIG. 12. Unlike the first oil collection groove 122, the second oil collection groove 400 is substantially wider than any of the other grooves formed in the piston 200. In the illustrated embodiment, the second oil collection groove 400 extends peripherally around the piston 200, but is interrupted over reduced-diameter portions of the body portion 106 that accommodate the pin bores 107, as is best shown in FIG. 10. A chamfer 310 is formed along the interface between the bottom of the second oil collection groove 400 and the body portion 106 of the piston 200.

In the specific embodiment of the piston 200 illustrated in FIGS. 8-12, the second oil collection groove 400 may be formed at a width, which is defined along the length of the piston 200, of about 9 mm and at a depth of about 5.34 mm. The chamfer 310 (FIG. 12) extends about 1.5 mm below the lower edge of the second oil collection groove 400 at an angle of about 20 degrees. Additionally, the upper edge, or the edge closest to the combustion bowl 114 of the piston 100, is located about 32.5 mm below the top face 116.

INDUSTRIAL APPLICABILITY

The on-engine performance of the disclosed embodiments for the pistons 100 and 200 was evaluated and compared to the performance of the baseline piston 18 previously used on those same engines. The results of this comparison showed an unexpected improvement in the operation of the engines relative to certain engine operating parameters that can affect the efficiency of operation of the engines, as well as certain parameters affecting the reliability and longevity of the engines. In sum, it is believed that the additional oil collection grooves, for example, the second oil collection groove 300 of piston 100 (see, e.g., FIG. 7) and the second oil collection groove 400 (see, e.g., FIG. 12), had a positive and unexpected effect in lowering the peak operating temperature of certain areas of the piston, as well as meaningfully and significantly reducing the oil consumption of the engines in which they operate. Moreover, a substantial reduction in oil deposits was observed in the first land and within the first piston ring seal groove of the pistons 100 and 200 as compared to the oil deposits observed in baseline pistons operating under the same testing cycles. A brief presentation of these performance improvements follows.

The first area of unexpected improvement in the operation of the pistons 100 and 200 relates to peak temperatures observed along the rim 117 of the combustion bowl 114 (see, e.g., FIGS. 5 and 10), which also represents the peak temperature of the piston during operation. In the baseline design, the steady state temperature at the rim of the combustion bowl for an engine operating at 1800 revolutions per minute (rpm) and at rated power, which for the engine tested was about 900 hp, was about 504 degrees Celsius (° C.). In that same engine application, with the engine operating under the same engine speed and power conditions, the piston 100 yielded a steady state temperature at the rim 117 of the combustion bowl 114 of about 427° C. This reduction of the temperature of the piston in this region represents an improvement of about 15.3%, which had not been expected prior to the test. Other areas of the improved pistons 100 and 200 exhibited similar improvements in operating temperature over corresponding areas of the baseline pistons operating in the same engines under the same conditions.

Another area of unexpected improvement in the operation of an engine having the pistons 100 or 200 installed and operating therein relates to the oil "consumed" by the engine. As is known, engine oil consumption during operation of the engine can be attributed to various factors, which include oil vaporizing within the engine crankcase that is removed via a crankcase ventilation system, oil passing through the seals of the piston and entering the combustion cylinders, and other factors. It has been determined that the improved pistons 100 or 200 yield a 50% or more reduction in engine oil consumption as compared to a baseline piston. For instance, an engine operating at a rated condition for about 250 hours may consume oil at a rate of about 0.0005 pounds of oil (about 0.002 kg) per horsepower-hour of operation with the baseline piston. A test using the same engine operating under the same conditions for the same time period, but having either the improved piston 100 or the improved piston 200 installed therein, yielded a rate of oil consumption that was about 0.00024 pounds (about 0.0009 kg) of oil for every horsepower-hour, which represents a reduction of about 52% in the rate of engine oil consumption over the baseline piston design.

An additional example of improved engine operation using the pistons 100 or 200 was observed. Following a tear down of test engines containing the baseline pistons, as well as of engines containing the improved pistons 100 or 200, a considerable reduction of the amount of oil deposits accumulated in the first or upper piston ring groove 118 and on the second land 126 (see, e.g., FIGS. 7 and 12) of the pistons 100 and 200 relative to the baseline pistons was observed. This result was also unexpected.

Based on the foregoing, it can be appreciated that the width of the second oil collection groove 300 or 400 (as shown, respectively, in FIGS. 7 and 12) is substantially greater than the width of the other grooves of the piston. For example, the first oil collection groove 122 (FIGS. 7 and 12) has a width of about 4 mm, which is typical for engine pistons. Moreover, the piston ring seal grooves 118 and 120 are of similar widths. This means that the second oil collection groove 300 or 400 on each piston 100 or 200 is more than twice as wide as a typical groove found on engine pistons, for example, pistons having a nominal or outer bore diameter of about 136 mm. As a practical matter, this difference in width between the second oil collection grooves and the other grooves included in a piston as disclosed herein avoids certain assembly errors, such as installation of a piston ring within an oil collection groove, and others, especially in the case when automated assembly methods are used. Robotic piston ring installation equipment, for example, may be constructed and arranged to discriminate against the second, wider oil collection groove when determining into which grooves certain ring seals should be installed.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

We claim:

1. A piston for an internal combustion engine, comprising:

a piston crown connected to and above a body portion of the piston, the body portion forming two pin bores, and the piston crown defining an outer cylindrical wall;

at least one piston ring seal groove formed in the outer cylindrical wall and extending peripherally around the piston crown, the at least one piston ring seal groove being configured to accommodate therein a piston ring seal;

a first oil drainage groove formed in the outer cylindrical wall below the at least one piston ring seal groove and extending in parallel to the at least one piston ring seal groove around an entire periphery of the piston, wherein the first oil drainage groove has a first width measured along a centerline of the piston;

a plurality of drain openings formed in the body portion, the plurality of drain openings fluidly connecting the first oil drainage groove with an internal gallery of the piston;

a second oil drainage groove formed in the outer cylindrical wall below and adjacent the first oil drainage groove, the second oil drainage groove defining a first channel, a second channel, and an annular protrusion disposed between the first channel and the second channel, the annular protrusion defining a reduced-diameter land portion;

wherein the second oil drainage groove extends parallel to the first oil drainage groove around the entire periphery of the piston but is interrupted over segments of the body portion that accommodate the two pin bores such that oil collected in the second oil drainage groove drains from the first channel to the second channel, and from the second channel back to the internal combustion engine through the segments and externally to the piston, wherein the second oil drainage groove has a width that is wider than the width of the first oil drainage groove; and at least one additional piston ring groove being sized to receive a piston ring seal therein, the at least one additional piston ring groove disposed adjacent the at least one piston ring seal groove.

2. The piston of claim 1, wherein the outer cylindrical wall has a first diameter, and wherein a reduced diameter land is defined by an annular portion of the piston that is disposed within the second oil drainage groove, wherein the reduced diameter land has an outer diameter that is less than the first diameter of the outer cylindrical wall.

3. The piston of claim 2, wherein the annular portion partitions the second oil drainage groove into a first channel that is disposed above the annular portion, and a second channel that is disposed below the annular portion.

4. The piston as set forth in claim 1, further comprising a barrier wall disposed adjacent the at least one piston ring groove and between said at least one piston ring and a recessed portion disposed below said at least one piston ring groove, the barrier wall configured to retain the piston ring disposed therein.

5. The piston according to claim 4, wherein said recessed portion is disposed in said weight balance section and comprises an annular groove defined by a nominal depth of 5.34 mm, the at least one piston ring seal groove is defined by a nominal width of 4 mm, and the barrier wall is defined by a nominal width of 4 mm.

6. The piston of claim 1, wherein the second oil drainage groove has a width that is at least twice as large as a width of the first oil drainage groove.

7. The piston of claim 1, wherein a nominal outer diameter of the piston is 136 mm, and wherein said recessed portions of said weight balance section is an annular groove defined by a nominal depth of 5.34 mm and a nominal width of 9 mm.

8. An internal combustion engine having a cylinder bore configured to reciprocally accept a piston, comprising:

a piston having a piston crown and a body portion, the piston crown defining an outer cylindrical wall and being connected to and above the body portion, the body portion forming two pin bores configured to pivotally connect the piston to a connecting rod of the engine;

at least one piston ring seal groove formed in the outer cylindrical wall and extending peripherally around the piston crown, the at least one piston ring seal groove being configured to accommodate therein a piston ring seal;

an additional piston ring groove configured to receive an additional piston ring therein, the additional piston ring groove disposed adjacent the at least one piston ring seal groove;

a first oil drainage groove formed in the outer cylindrical wall below and adjacent to the additional piston ring seal groove, the first oil drainage groove extending in parallel to the at least one piston ring seal groove around an entire periphery of the piston, wherein the first oil drainage groove has a first width measured along a centerline of the piston;

a plurality of drain openings formed in the body portion, the plurality of drain openings fluidly connecting the first oil drainage groove with an internal gallery of the piston; and a second oil drainage groove formed in the outer cylindrical wall below and adjacent the first oil drainage groove, the second oil drainage groove defining a first channel, a second channel, and an annular protrusion disposed between the first channel and the second channel, the annular protrusion defining a reduced-diameter land portion;

wherein the second oil drainage groove extends parallel to the first oil drainage groove around the entire periphery of the piston but is interrupted over segments of the body portion that accommodate the two pin bores such that oil collected in the second oil drainage groove drains from the first channel to the second channel, and from the second channel back to the internal combustion engine through the segments and externally to the piston is provided, wherein the second oil drainage groove has a width that is wider than the width of the first oil drainage groove.

9. The internal combustion engine of claim 8, further comprising a reduced diameter land is defined by an annular portion of the piston that is disposed within the second oil drainage groove, wherein the outer cylindrical wall has a first outer diameter, and wherein the reduced diameter land has a second outer diameter that is less than the first outer diameter.

10. The internal combustion engine of claim 9, wherein the annular portion partitions the second oil drainage groove into a first channel that is disposed above the annular portion, and a second channel that is disposed below the annular portion.

11. The internal combustion engine of claim 8, wherein a nominal outer diameter of the piston is 136 mm, and wherein said recessed portions of said weight balance section is an annular groove defined by a nominal depth of 5.34 mm and a nominal width of 9 mm.

12. The internal combustion engine of claim 8, wherein said recessed portion is disposed in said weight balance section and comprises an annular groove defined by a nominal depth of 5.34 mm, the at least one piston ring seal groove is defined by a nominal width of 4 mm, and the barrier wall is defined by a nominal width of 4 mm.

13. A piston for an internal combustion engine, comprising:

a piston crown connected to and above a body portion of the piston, the body portion forming two pin bores, and the piston crown defining an outer cylindrical wall;

at least one piston ring seal groove formed in the outer cylindrical wall and extending peripherally around the piston crown, said at least one piston ring seal groove has tapered walls forming a generally V-shaped cross section;

a first oil drainage groove formed in the outer cylindrical wall below the at least one piston ring seal groove and extending in parallel to the at least one piston ring seal groove around an entire periphery of the piston, wherein the first oil drainage groove has a generally rectangular cross section;

a plurality of drain openings formed in the body portion, the plurality of drain openings fluidly connecting the first oil drainage groove with an internal gallery of the piston;

a second oil drainage groove formed in the outer cylindrical wall directly below the first oil drainage groove without any piston ring seal grooves disposed therebetween, the second oil drainage groove defining a first channel, a second channel, and an annular protrusion disposed between the first channel and the second channel, the annular protrusion defining a reduced-diameter land portion;

wherein the second oil drainage groove extends extending parallel to the first oil drainage groove around the entire periphery of the piston, is interrupted over segments of the body portion that accommodate the two pin bores, and has a generally rectangular cross section;

wherein oil collected in the first channel drains into the second channel, and from the second channel oil drains back into the internal combustion engine through the segments of the body portion that accommodate the two pin bores and externally to the piston;

wherein the second oil drainage groove is at least twice as wide as the first oil drainage groove, and wherein the rectangular cross section of the first and second oil collection grooves makes them distinguishable from the at least one piston ring seal groove having the generally V-shaped cross section to automated piston ring seal installation equipment.

* * * * *